US011319782B2

(12) United States Patent
Snitkoff et al.

(10) Patent No.: US 11,319,782 B2
(45) Date of Patent: May 3, 2022

(54) MODULAR SCREEN FOR A RESOURCE EXPLORATION AND RECOVERY TUBULAR

(71) Applicants: Joshua Raymond Snitkoff, Houston, TX (US); Jeffrey Allan Higginbotham, Humble, TX (US); Elliott David Tuttle, Anchorage, AK (US); Charles Alexander McClean, Spring, TX (US)

(72) Inventors: Joshua Raymond Snitkoff, Houston, TX (US); Jeffrey Allan Higginbotham, Humble, TX (US); Elliott David Tuttle, Anchorage, AK (US); Charles Alexander McClean, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/023,493

(22) Filed: Sep. 17, 2020

(65) Prior Publication Data

US 2022/0081997 A1 Mar. 17, 2022

(51) Int. Cl.
*E21B 43/08* (2006.01)
*E21B 43/10* (2006.01)
*E21B 43/12* (2006.01)

(52) U.S. Cl.
CPC ..... *E21B 43/08* (2013.01); *E21B 43/10* (2013.01); *E21B 43/12* (2013.01)

(58) Field of Classification Search
CPC ..... E21B 43/08; E21B 43/10; E21B 43/12; E21B 43/088; E21B 43/082; E21B 434/06
See application file for complete search history.

(56) References Cited

U.S. PATENT DOCUMENTS

| | | | | |
|---|---|---|---|---|
| 2,391,609 | A * | 12/1945 | Wright | E21B 43/082 166/228 |
| 7,240,739 | B2 * | 7/2007 | Schoonderbeek | E21B 43/12 166/386 |
| 7,258,166 | B2 * | 8/2007 | Russell | E21B 43/082 166/229 |
| 7,644,758 | B2 * | 1/2010 | Coronado | E21B 34/08 166/205 |
| 8,448,659 | B2 * | 5/2013 | Veit | F16K 15/025 137/111 |
| 9,212,540 | B2 * | 12/2015 | Woiceshyn | E21B 43/08 |
| 2017/0044879 | A1 * | 2/2017 | Kang | E21B 43/088 |
| 2019/0024478 | A1 * | 1/2019 | Mathiesen | E21B 34/14 |
| 2019/0169959 | A1 * | 6/2019 | Kumar | E21B 34/063 |
| 2020/0408066 | A1 * | 12/2020 | Mathiesen | F16K 15/14 |

FOREIGN PATENT DOCUMENTS

| | | | |
|---|---|---|---|
| CA | 2459567 | A1 | 3/2003 |
| CA | 2520141 | A1 | 10/2004 |

* cited by examiner

*Primary Examiner* — Michael R Wills, III
(74) *Attorney, Agent, or Firm* — Cantor Colburn LLP

(57) ABSTRACT

A modular screen system includes a tubular member having an outer surface defining an outer diameter and an inner surface defining an inner diameter. The outer surface includes an opening and a recess extending about the opening. A flow control device is positioned at the opening in the recess, and a screen member is detachably mounted to the tubular in the recess. The screen member includes a filtering surface that does not project proudly of the outer surface.

20 Claims, 7 Drawing Sheets

MODULAR SCREEN FOR A RESOURCE EXPLORATION AND RECOVERY TUBULAR

BACKGROUND

In the resource recovery industry screens are employed to filter sand and other particles from production fluids such as gas and/or petroleum. Typically, the screen is constructed about a tubular. Inflow control devices are added to the tubular to control fluid flow through the screen. In thru tubing designs it is difficult to incorporate a flow control device into a screen. That is, the inflow control device adds thickness that hampers insertion of a screen mandrel into another tubular. In a thru tubing installations, the screen mandrel is run into, for example, a casing tubular.

As such, an outside diameter (OD) of the screen mandrel must be maintained within specific tolerances. Increasing the OD too much may result in the screen mandrel binding. Incorporating a flow control device to the screen mandrel once a sand screen is added often times drives the OD to the edge of or beyond the specific tolerances. Thus, in thru tubing installations it is difficult to adjust an amount of inflow area based on reservoir permeability, type and size of inflow control device as well as other factors. Accordingly, the industry would welcome a system for incorporating screens and inflow control devices into a screen mandrel for a thru tubing installation.

SUMMARY

Disclosed is a modular screen system including a tubular member having an outer surface defining an outer diameter and an inner surface defining an inner diameter. The outer surface includes an opening and a recess extending about the opening. A flow control device is positioned at the opening in the recess, and a screen member is detachably mounted to the tubular in the recess. The screen member includes a filtering surface that does not project proudly of the outer surface.

Also disclosed is a resource exploration and recovery system including a surface system, a subterranean system including a tubular, and a modular screen system extending through the tubular. The modular screen system includes a tubular member including an outer surface defining an outer diameter and an inner surface defining an inner diameter. The outer surface includes an opening and a recess extending about the opening. A flow control device is positioned at the opening in the recess, and a screen member is detachably mounted to the tubular in the recess. The screen member includes a filtering surface that does not project proudly of the outer surface.

Further disclosed is a method of filtering formation fluids in a thru tubular system. The method includes installing a flow control device across an opening defined in a recess formed in an outer surface of a tubular member, detachably connecting a screen member in the recess, the screen member having a filtering surface that does not project proudly of the outer surface, monitoring parameters of at least one of formation fluids passing to the flow control device and the formation, and replacing the screen member based on the parameters.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
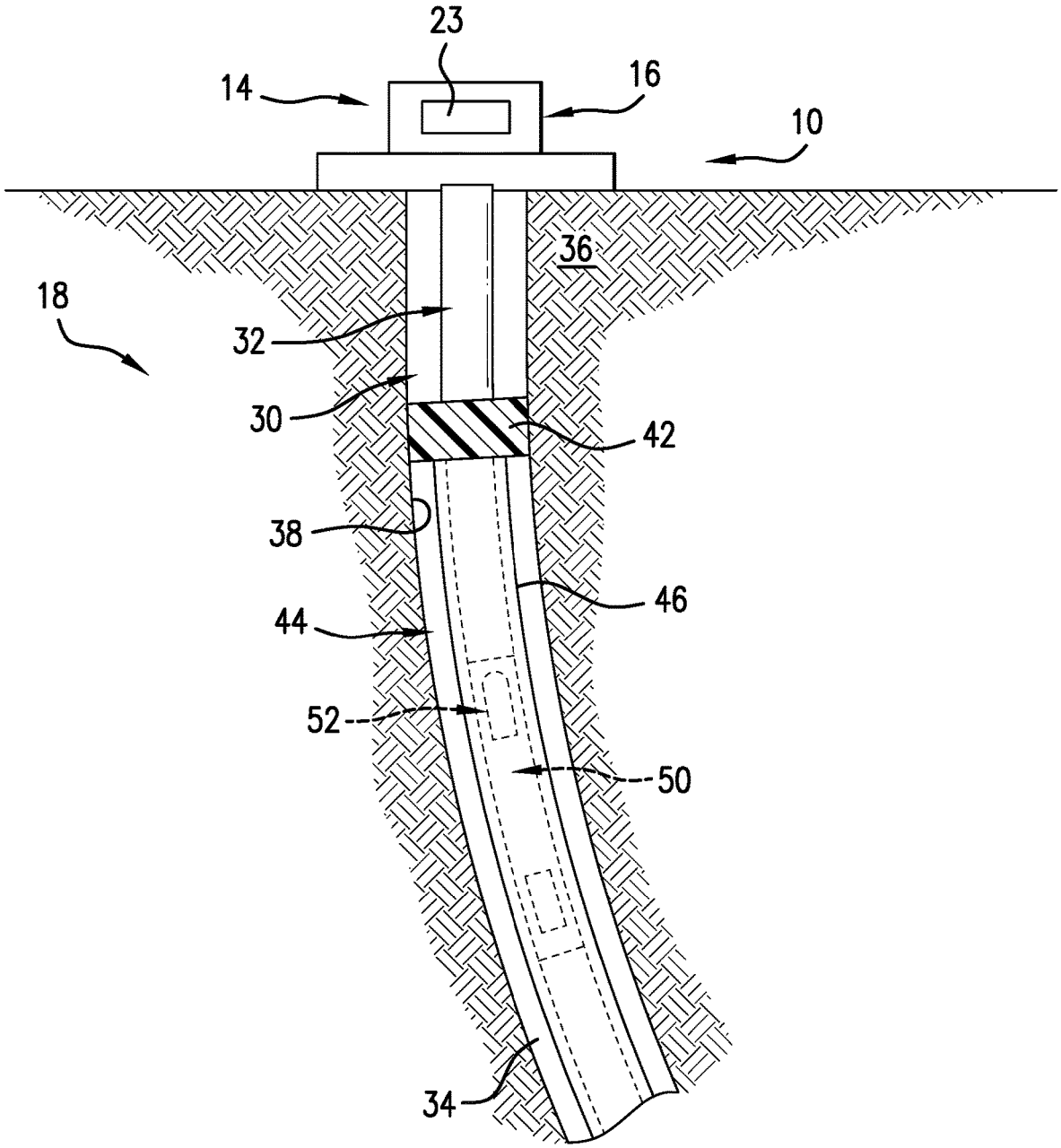
FIG. 1 depicts a resource exploration and recovery system including a modular screen system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system. First system 14 may include a control system 23 that may provide power to, monitor, communicate with, monitor downhole parameters, and/or activate one or more downhole operations as will be discussed herein. Surface system 16 may include additional systems such as pumps, fluid storage systems, cranes and the like (not shown).

Second system 18 may include a work string 30, formed from one or more tubular members, such as indicated at 32, which extends into a wellbore 34 formed in a formation 36. Work string 30 is part of a thru tubular system (not separately labeled) that may transport production fluids to surface system 16. Wellbore 34 includes an annular wall 38 which may be defined by a surface (not separately labeled) of formation 36. At least one packer, such as indicated at 42 is provided in wellbore 34. A production zone 44 is defined downhole of packer 42. The number, length and spacing of production zones may vary. A tubular 46 extends from packer 42 downhole. Tubular 46 may include openings (not shown) that are receptive of production fluids passing from formation 36 into wellbore 34.

Figure 2:
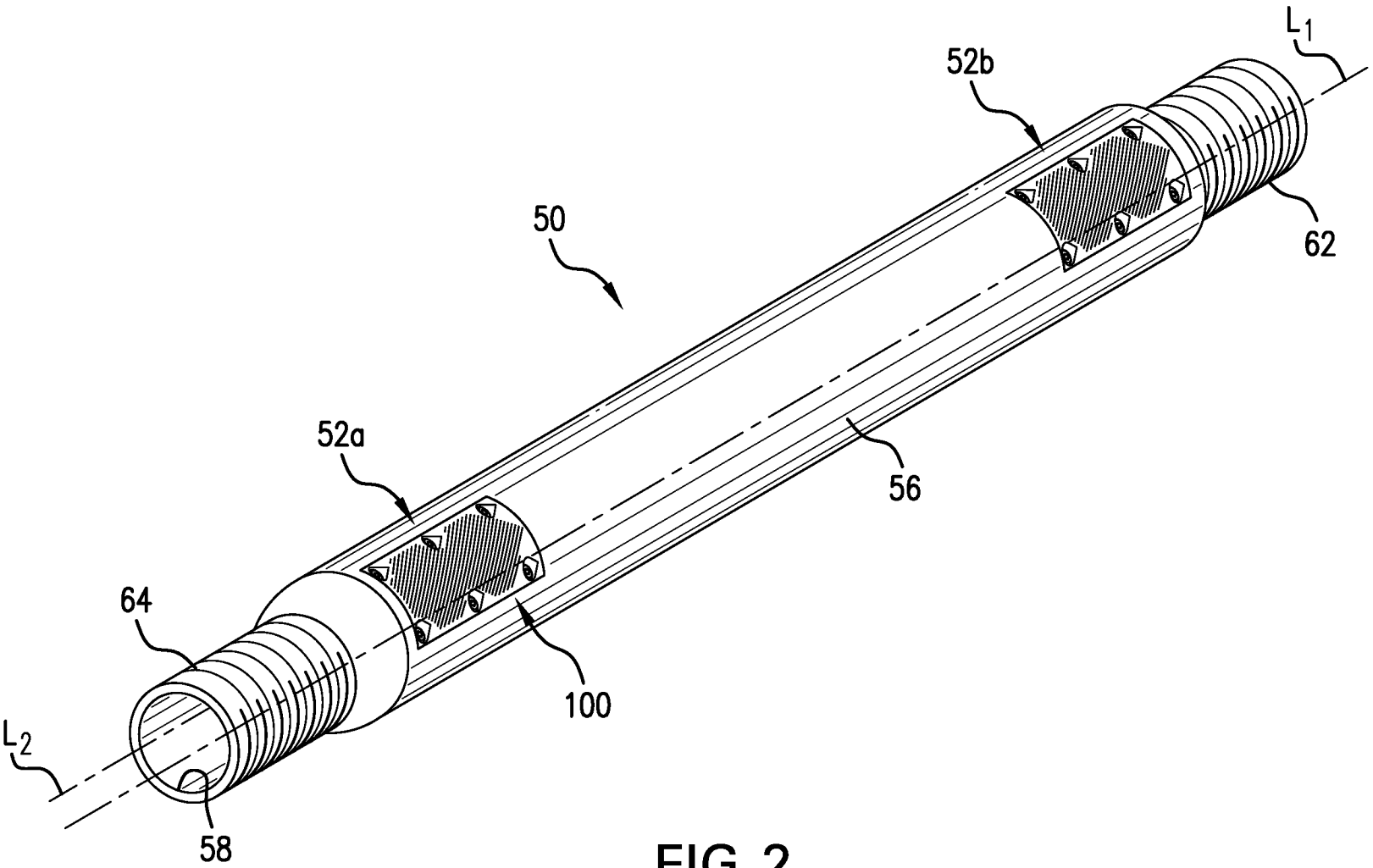
FIG. 2 depicts a screen mandrel including a modular screen system, in accordance with an exemplary embodiment.
Figure 3:
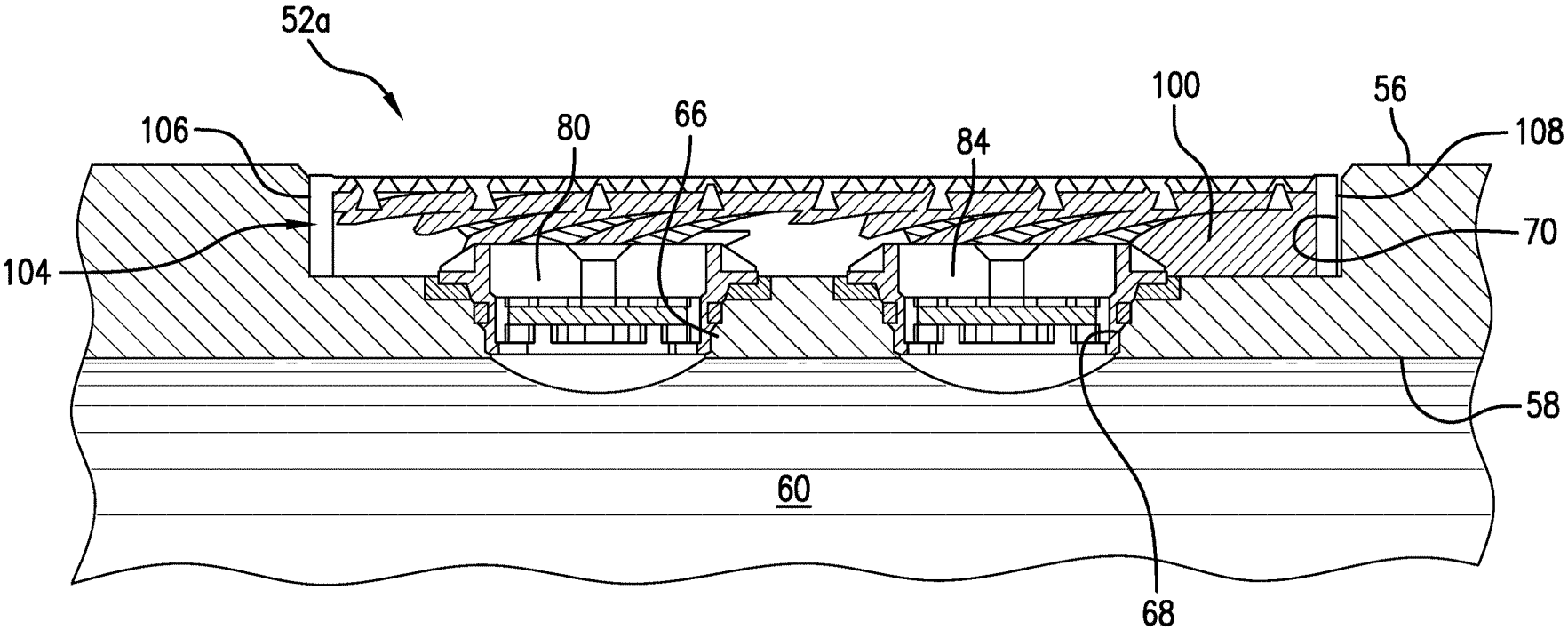
FIG. 3 depicts a cross-sectional side view of the screen mandrel of FIG. 2, in accordance with an exemplary embodiment.
Figure 4:
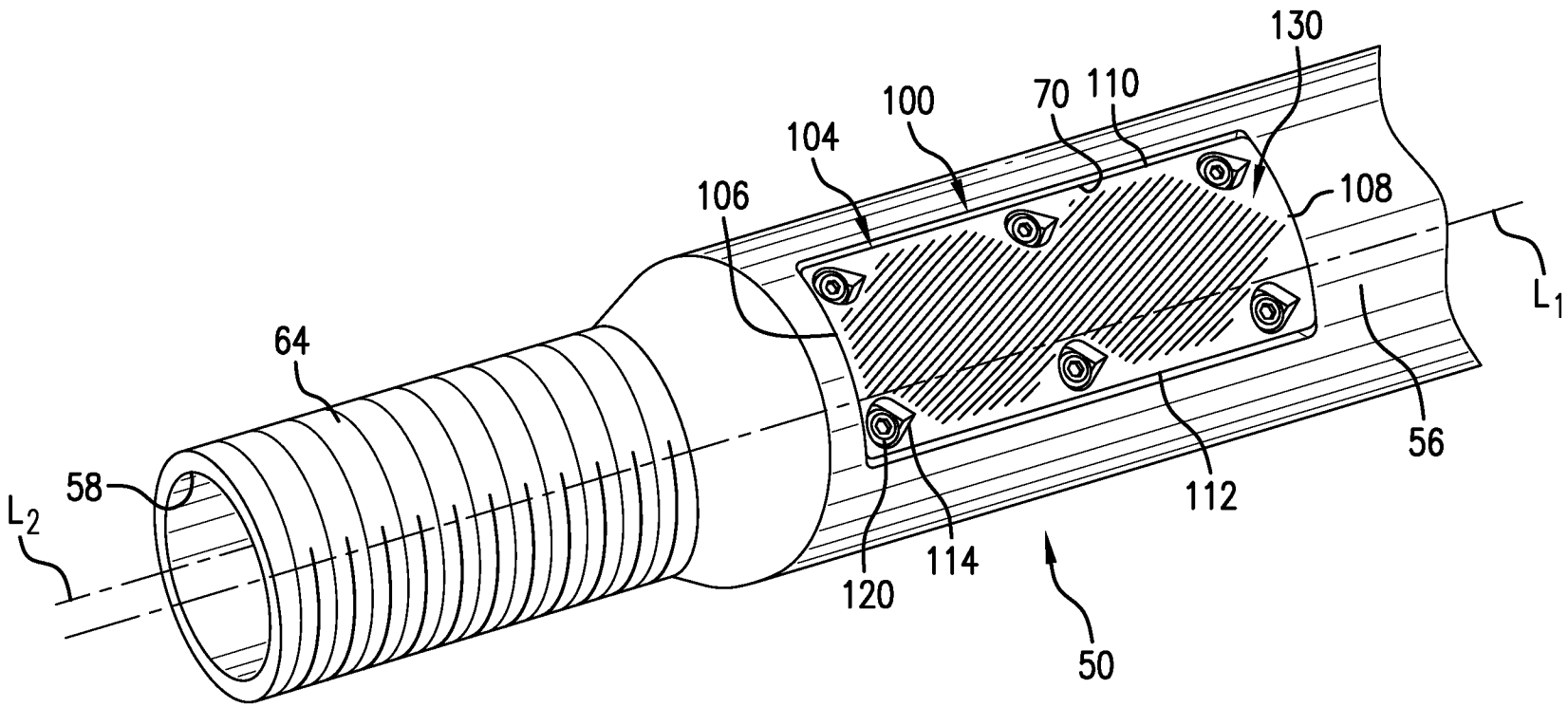
FIG. 4 depicts an axial end of the screen mandrel of FIG. 2, in accordance with an exemplary embodiment.

One or more of tubular members 32 may define a screen mandrel 50 that supports a modular screen system 52. Referring to FIGS. 2-4, screen mandrel 50 includes an outer surface 56 and an inner surface 58 defining a flowbore 60. Flowbore 60 extends from a first end 62 of screen mandrel 50 to a second end 64 of screen mandrel 50. Outer surface 56 defined an outer diameter (not separately labeled) having a first longitudinal axis "L1" and inner surface 58 defines an inner diameter (also not separately labeled) having a second longitudinal axis "L2". In an embodiment, second longitudinal axis "L2" is offset from first longitudinal axis "L1"

such that screen mandrel 50 defines an eccentric pipe wherein the inner diameter and the outer diameter are not concentric.

Screen mandrel 50 includes a first opening 66 extending through outer surface 56 and inner surface 58. A second opening 68 is axially spaced from first opening 66. Second opening 68 also extends through outer surface 56 and inner surface 58. First and second openings 66 and 68 are surrounded by a recess 70. A first flow control device 80 is arranged in recess 70 at first opening 66. A second flow control device 84 is arranged in recess 70 at second opening 68. It should be understood that first and second flow control devices may take on various forms including self-controlled inflow control devices, orifice valves and the like. It should also be understood that the number of openings and corresponding flow control devices may vary.

Figure 5:
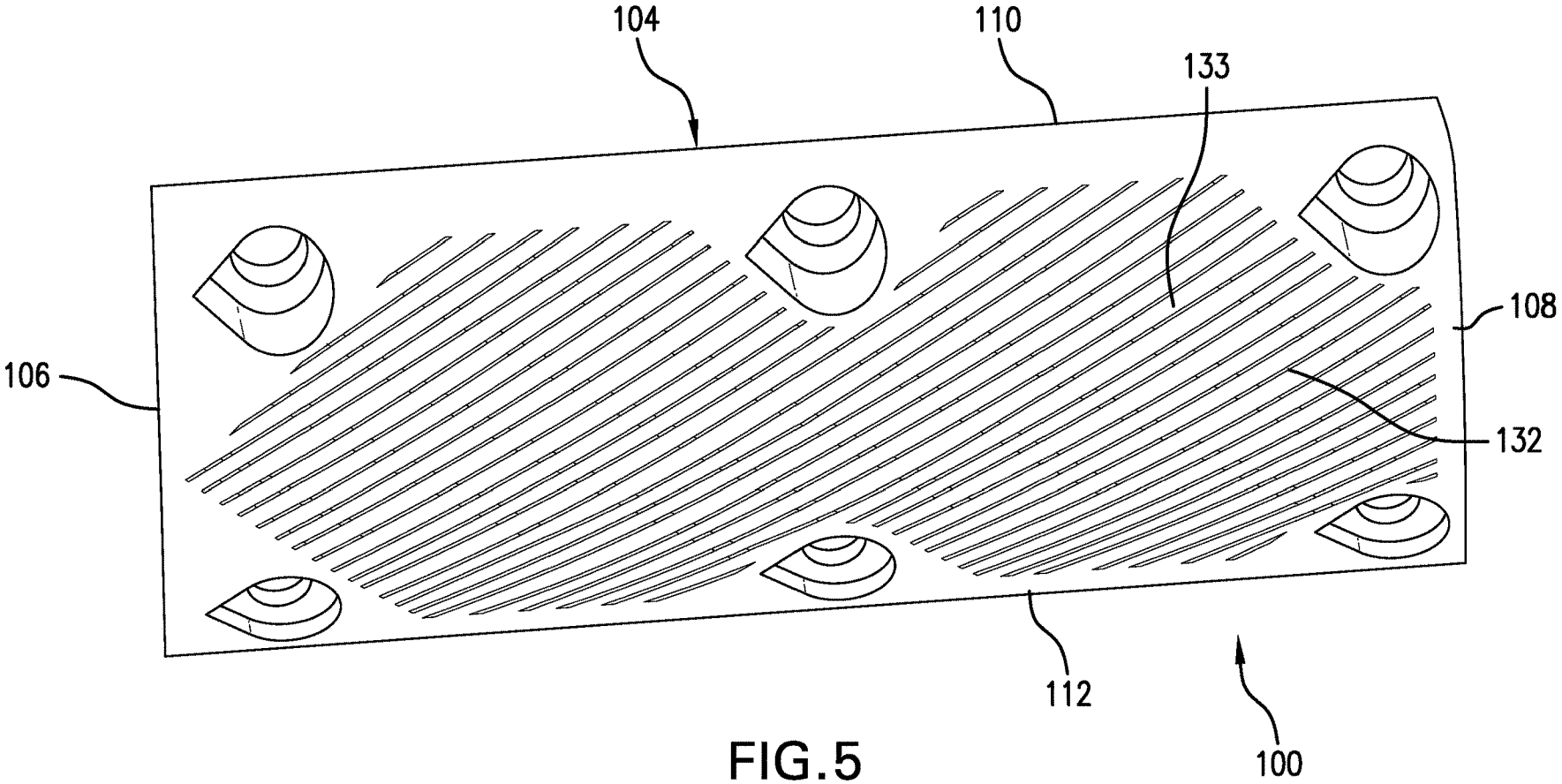
FIG. 5 depicts a first side of a screen member, of the modular screen system, in accordance with an exemplary embodiment.
Figure 6:
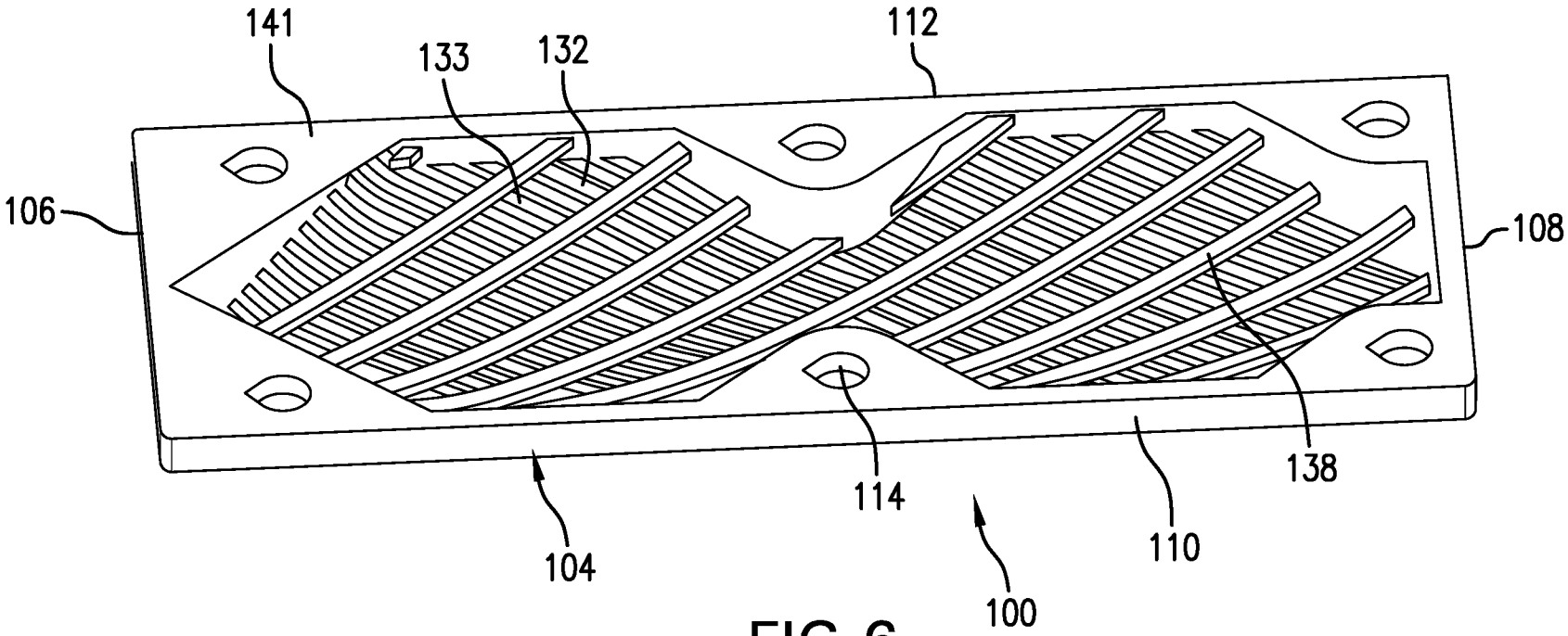
FIG. 6 depicts a second side of the screen member of FIG. 5, in accordance with an exemplary embodiment.

In accordance with an exemplary embodiment, a screen member 100 is arranged in recess 70 across first and second flow control devices 80 and 84. As shown in FIGS. 5 and 6, screen member 100 includes a peripheral edge 104 having a first end section 106 and opposing second end section 108, a first side section 110 and an opposing second side section 112.

First and second end sections 106 and 108 are substantially parallel to one another. Likewise, first and second side sections are substantially parallel. Of course, it should be understood that parallel ends and sides are just one representative geometry for screen member 100. A plurality of openings, one of which is indicated at 114, extend along each of first side section 110 and second side section 112. Openings 114 are receptive of mechanical fasteners 120, such as threaded fasteners, that are employed to secure screen member 100 to screen mandrel 50.

In an embodiment, screen member 100 includes a filtering surface 130 that does not extend beyond outer surface 56 when mounted in recess 70. Filtering surface 130 may, in some arrangements, remain recessed relative to outer surface 546 when screen member 100 is mounted in recess 70. Filtering surface 130 includes a plurality of openings 132 defined between a plurality of grille elements 133. As such, openings 132 may take the form of slots. As shown in FIG. 6, grille elements 133 may be supported by a plurality of reinforcing members 138 provided on an inside surface 141 of screen member 100. As will be detailed herein, screen member 100 may be formed from steel and manufactured through an additive manufacturing process.

Figure 7:
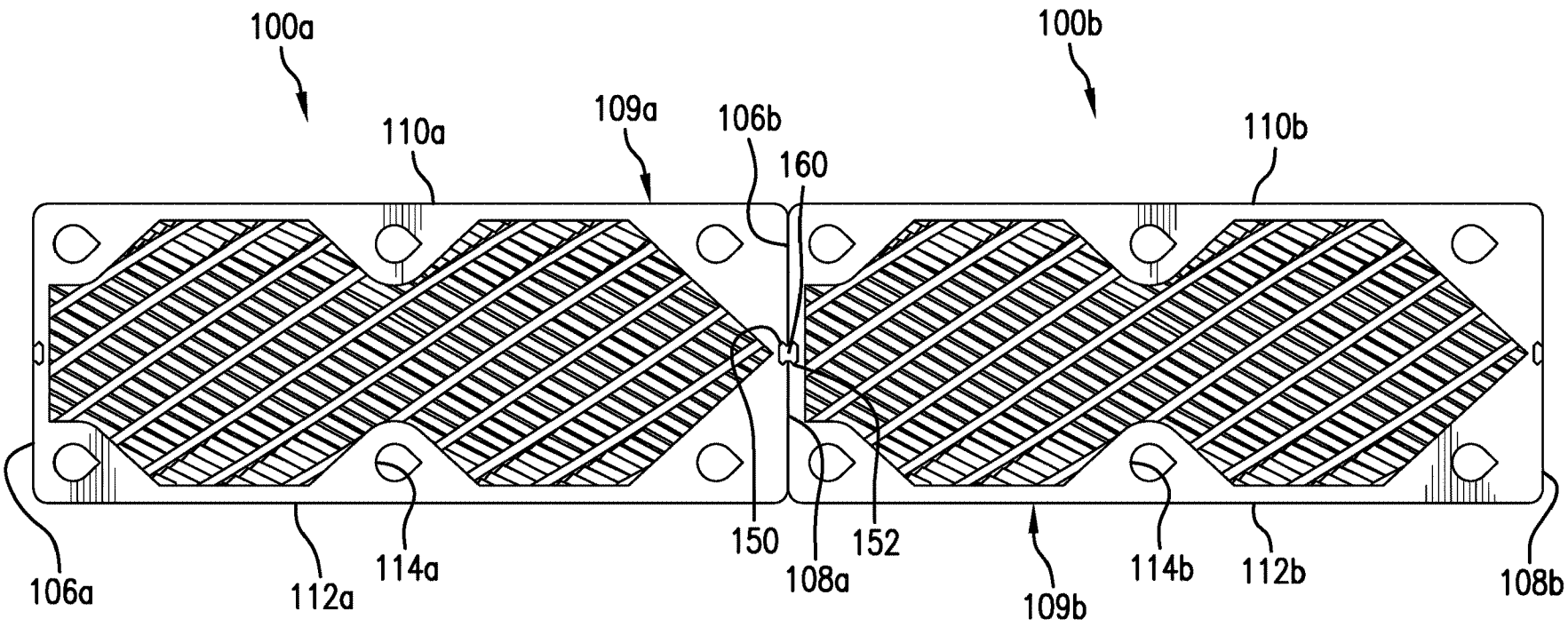
FIG. 7 depicts first and second stacked screen members, in accordance with an exemplary embodiment.

In accordance with an exemplary aspect illustrated in FIG. 7, a first screen member 100A is stacked with a second screen member 100B. First screen member 100A includes a peripheral edge 104A having a first end section 106A and opposing second end section 108A, a first side section 110A and an opposing second side section 112A. Similarly, second screen member 100B includes a peripheral edge 104B having a first end section 106B and opposing second end section 108B, a first side section 110B and an opposing second side section 112B. Second end section 108A includes a first recess portion 150 and first end section 106B includes a second recess portion 152. A connector 160 is inserted into first and second recess portions 150 and 152 to secure first screen member 100A to second screen member 100B. By stacking screen members, inflow control may be tailored to formation parameters.

In an embodiment, control system 23 may be used to monitor parameters of wellbore 34. For example, formation permeability may be monitored, formation fluid parameters may be monitored, flow to surface system 16 may be monitored to determine whether screen member 100 includes openings that are optimized for current wellbore conditions. If wellbore conditions change, new screen members may be quickly manufactured so as to have a minimal impact on wellbore operations. Further, a new screen member may be modeled and manufactured while work string is being run out of the wellbore so as to be ready for a quick exchange. In this manner, the work string may be quickly run back into the wellbore to continue production.

Set forth below are some embodiments of the foregoing disclosure:

Embodiment 1. A modular screen system comprising: a tubular member including an outer surface defining an outer diameter and an inner surface defining an inner diameter, the outer surface including an opening and a recess extending about the opening; a flow control device positioned at the opening in the recess; and a screen member detachably mounted to the tubular in the recess, the screen member including a filtering surface that does not project proudly of the outer surface.

Embodiment 2. The modular screen system according to any prior embodiment, wherein the screen member is secured to the tubular through mechanical fasteners.

Embodiment 3. The modular screen system according to any prior embodiment, wherein the mechanical fasteners are threaded fasteners.

Embodiment 4. The modular screen system according to any prior embodiment, wherein the screen member includes a first screen member and a second screen member arranged in the recess.

Embodiment 5. The modular screen system according to any prior embodiment, further comprising: a connector joining the first screen member and the second screen member.

Embodiment 6. The modular screen system according to any prior embodiment, wherein the first screen member includes a first peripheral edge including a first recess portion and the second screen member includes a second peripheral edge including a second recess portion, the connector being arranged in each of the first and second recess portions to join the first screen member and the second screen member.

Embodiment 7. The modular screen system according to any prior embodiment, wherein the screen member is additively manufactured.

Embodiment 8. The modular screen system according to any prior embodiment, wherein the outer diameter of the tubular defines a first longitudinal axis and the inner diameter of the tubular defines a second longitudinal axis that is offset relative to the first longitudinal axis.

Embodiment 9. A resource exploration and recovery system comprising: a surface system; a subterranean system including a tubular; and a modular screen system extending through the tubular, the modular screen system comprising: a tubular member including an outer surface defining an outer diameter and an inner surface defining an inner diameter, the outer surface including an opening and a recess extending about the opening; a flow control device positioned at the opening in the recess; and a screen member detachably mounted to the tubular in the recess, the screen member including a filtering surface that does not project proudly of the outer surface.

Embodiment 10. The resource exploration and recovery system according to any prior embodiment, wherein the screen member is secured to the tubular through mechanical fasteners.

Embodiment 11. The resource exploration and recovery system according to any prior embodiment, wherein the mechanical fasteners are threaded fasteners.

Embodiment 12. The resource exploration and recovery system according to any prior embodiment, wherein the screen member includes a first screen member and a second screen member arranged in the recess.

Embodiment 13. The resource exploration and recovery system according to any prior embodiment, further comprising: a connector joining the first screen member and the second screen member.

Embodiment 14. The resource exploration and recovery system according to any prior embodiment, wherein the first screen member includes a first peripheral edge including a first recess portion and the second screen member includes a second peripheral edge including a second recess portion, the connector being arranged in each of the first and second recess portions to join the first screen member and the second screen member.

Embodiment 15. The resource exploration and recovery system according to any prior embodiment, wherein the screen member is additively manufactured.

Embodiment 16. The resource exploration and recovery system according to any prior embodiment, wherein the outer diameter of the tubular defines a first longitudinal axis and the inner diameter of the tubular defines a second longitudinal axis that is offset relative to the first longitudinal axis.

Embodiment 17. A method of filtering formation fluids in a thru tubular system, the method comprising: installing a flow control device across an opening defined in a recess formed in an outer surface of a tubular member; detachably connecting a screen member in the recess, the screen member having a filtering surface that does not project proudly of the outer surface; monitoring parameters of at least one of formation fluids passing to the flow control device and the formation; and replacing the screen member based on the parameters.

Embodiment 18. The method according to any prior embodiment, wherein replacing the screen member includes modeling a new screen member having filtering characteristics tuned to the parameters.

Embodiment 19. The method according to any prior embodiment, wherein replacing the screen member includes additively manufacturing the new screen member.

Embodiment 20. The method according to any prior embodiment, wherein detachably connecting the screen member includes attaching a first screen member to a second screen member and connecting the first and second screen members to the tubular in the recess.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A modular screen system comprising:

a tubular member including an outer surface defining an outer diameter and an inner surface defining an inner diameter, the outer surface including an opening and a recess extending about the opening;

a flow control device positioned at the opening in the recess; and a screen member detachably mounted to the tubular in the recess, the screen member including a filtering surface that does not project beyond the outer surface.

2. The modular screen system according to claim 1, wherein the screen member is secured to the tubular through mechanical fasteners.

3. The modular screen system according to claim 2, wherein the mechanical fasteners are threaded fasteners.

4. The modular screen system according to claim 1, wherein the screen member includes a first screen member and a second screen member arranged in the recess.

5. The modular screen system according to claim 4, further comprising: a connector joining the first screen member and the second screen member.

6. The modular screen system according to claim 5, wherein the first screen member includes a first peripheral edge including a first recess portion and the second screen member includes a second peripheral edge including a second recess portion, the connector being arranged in each of the first and second recess portions to join the first screen member and the second screen member.

7. The modular screen system according to claim 1, wherein the screen member is additively manufactured.

8. The modular screen system according to claim 1, wherein the outer diameter of the tubular defines a first longitudinal axis and the inner diameter of the tubular defines a second longitudinal axis that is offset relative to the first longitudinal axis.

9. A resource exploration and recovery system comprising:

a surface system;

a subterranean system including a tubular; and a modular screen system extending through the tubular, the modular screen system comprising:

a tubular member including an outer surface defining an outer diameter and an inner surface defining an inner diameter, the outer surface including an opening and a recess extending about the opening;

a flow control device positioned at the opening in the recess; and a screen member detachably mounted to the tubular in the recess, the screen member including a filtering surface that does not project beyond the outer surface.

10. The resource exploration and recovery system according to claim 9, wherein the screen member is secured to the tubular through mechanical fasteners.

11. The resource exploration and recovery system according to claim 10, wherein the mechanical fasteners are threaded fasteners.

12. The resource exploration and recovery system according to claim 9, wherein the screen member includes a first screen member and a second screen member arranged in the recess.

13. The resource exploration and recovery system according to claim 12, further comprising: a connector joining the first screen member and the second screen member.

14. The resource exploration and recovery system according to claim 13, wherein the first screen member includes a first peripheral edge including a first recess portion and the second screen member includes a second peripheral edge including a second recess portion, the connector being arranged in each of the first and second recess portions to join the first screen member and the second screen member.

15. The resource exploration and recovery system according to claim 9, wherein the screen member is additively manufactured.

16. The resource exploration and recovery system according to claim 9, wherein the outer diameter of the tubular defines a first longitudinal axis and the inner diameter of the tubular defines a second longitudinal axis that is offset relative to the first longitudinal axis.

17. A method of filtering formation fluids in a thru tubular system, the method comprising:

installing a flow control device across an opening defined in a recess formed in an outer surface of a tubular member;

detachably connecting a screen member in the recess, the screen member having a filtering surface that does not project beyond the outer surface;

monitoring parameters of at least one of formation fluids passing to the flow control device and the formation; and replacing the screen member based on the parameters.

18. The method of claim 17, wherein replacing the screen member includes modeling a new screen member having filtering characteristics tuned to the parameters.

19. The method of claim 18, wherein replacing the screen member includes additively manufacturing the new screen member.

20. The method of claim 17, wherein detachably connecting the screen member includes attaching a first screen member to a second screen member and connecting the first and second screen members to the tubular in the recess.

* * * * *